US007424931B2

(12) United States Patent
Smith

(10) Patent No.: US 7,424,931 B2
(45) Date of Patent: Sep. 16, 2008

(54) MUFFLER FOR A MOTORCYCLE

(75) Inventor: Stacy L. Smith, Oconomowoc, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 315 days.

(21) Appl. No.: 11/321,440

(22) Filed: Dec. 29, 2005

(65) Prior Publication Data

US 2007/0151798 A1 Jul. 5, 2007

(51) Int. Cl.
*F01N 1/10* (2006.01)
*F01N 1/24* (2006.01)
*F01N 1/04* (2006.01)

(52) U.S. Cl. ..... 181/256; 181/252; 181/227

(58) Field of Classification Search ..... 181/256, 181/252, 249, 255, 258, 269, 236, 227, 228
See application file for complete search history.

(56) References Cited

U.S. PATENT DOCUMENTS

| | | | | | |
|---|---|---|---|---|---|
| 963,822 | A * | 7/1910 | Smith | 181/269 |
| 2,523,260 | A * | 9/1950 | Campbell | 181/256 |
| 3,175,640 | A * | 3/1965 | Masayuki | 181/252 |
| 3,209,859 | A * | 10/1965 | Lentz et al. | 181/269 |
| 3,233,697 | A * | 2/1966 | Games et al. | 181/245 |
| 3,545,565 | A * | 12/1970 | McCaffrey, Jr. | 181/256 |
| 3,710,891 | A * | 1/1973 | Flugger | 181/256 |
| 3,765,506 | A * | 10/1973 | Strunk | 181/252 |
| 3,901,350 | A * | 8/1975 | Loffelhardt | 181/256 |
| 4,108,275 | A * | 8/1978 | Black et al. | 181/252 |
| 4,550,799 | A * | 11/1985 | Flugger | 181/244 |
| 4,637,491 | A * | 1/1987 | Fukuda | 181/265 |
| 4,842,096 | A * | 6/1989 | Fujitsubo | 181/252 |
| 5,892,186 | A * | 4/1999 | Flugger | 181/252 |
| 6,138,791 | A | 10/2000 | Zanzie | |
| 6,332,511 | B1 * | 12/2001 | Parlato et al. | 181/282 |
| 6,640,927 | B1 * | 11/2003 | Turner | 181/252 |
| 6,840,348 | B2 * | 1/2005 | Takewaka et al. | 181/252 |
| 6,857,502 | B2 * | 2/2005 | Naito | 181/252 |

* cited by examiner

*Primary Examiner*—Edgardo San Martin
(74) *Attorney, Agent, or Firm*—Michael Best & Friedrich LLP

(57) ABSTRACT

A muffler for a motorcycle, the muffler including an outer tube and an inner tube disposed substantially within the outer tube. The inner tube includes a first end adapted to receive the exhaust gases from the engine, a second end opposite the first end adapted to release the exhaust gases to the environment, and first and second apertures positioned between the ends. The muffler also includes a mesh tube disposed between the outer tube and the inner tube. The mesh tube defines a chamber between the inner tube and the mesh tube such that the exhaust gases exit the inner tube through the first aperture into the chamber, and exit the chamber into the inner tube through the second aperture. The muffler also includes a noise attenuating material disposed between the mesh tube and the outer tube.

16 Claims, 6 Drawing Sheets

MUFFLER FOR A MOTORCYCLE

BACKGROUND

The present invention relates to mufflers. More specifically, the present invention relates to mufflers for motorcycles.

SUMMARY

In one embodiment, the invention provides a muffler for a motorcycle having an engine producing exhaust gases. The muffler includes an outer tube and an inner tube disposed substantially within the outer tube. The inner tube includes a first end adapted to receive the exhaust gases from the engine, a second end opposite the first end adapted to release the exhaust gases to the environment, and first and second apertures positioned between the ends. The muffler also includes a mesh tube disposed between the outer tube and the inner tube. The mesh tube defines a chamber between the inner tube and the mesh tube such that the exhaust gases exit the inner tube through the first aperture into the chamber, and exit the chamber into the inner tube through the second aperture. The muffler also includes a noise attenuating material disposed between the mesh tube and the outer tube.

In another embodiment, the invention provides a muffler including an outer tube and an inner tube disposed substantially within the outer tube. The inner tube includes a first end adapted to receive the exhaust gases from the engine, a second end opposite the first end adapted to release the exhaust gases to the environment, and first and second apertures positioned between the ends. The muffler also includes an intermediate tube disposed between the outer tube and the inner tube. The intermediate tube defines a chamber between the inner tube and the intermediate tube such that the exhaust gases exit the inner tube through the first aperture into the chamber, and exit the chamber into the inner tube through the second aperture. The muffler also includes single-strand fiberglass roving disposed between the intermediate tube and the outer tube.

In another embodiment, the invention provides a muffler including an outer tube and an inner tube disposed substantially within the outer tube. The inner tube includes a first end adapted to receive the exhaust gases from the engine, a second end opposite the first end adapted to release the exhaust gases to the environment, the inner tube including first and second apertures positioned between the ends. The muffler also includes an intermediate tube disposed between the outer tube and the inner tube. The intermediate tube defines a chamber between the inner tube and the intermediate tube such that the exhaust gases exit the inner tube through the first aperture into the chamber, and exit the chamber into the inner tube through the second aperture. The muffler also includes single-strand fiberglass roving and fiberglass mat disposed between the intermediate tube and the outer tube.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
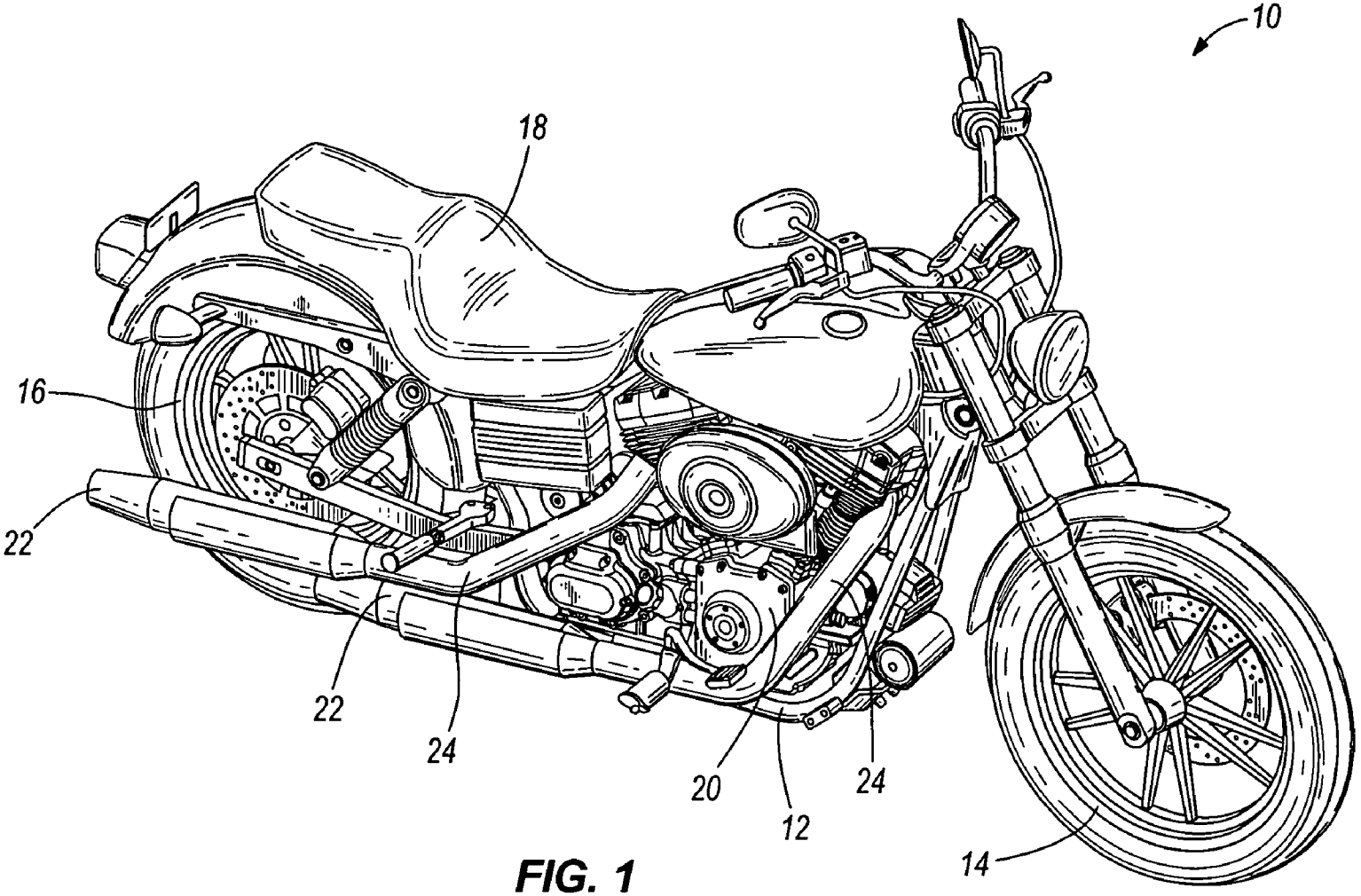
FIG. 1 is a perspective view of a motorcycle having a muffler embodying the present invention.

FIG. 1 illustrates a motorcycle 10 including a frame 12, front and rear wheels 14, 16, a seat 18, an engine 20, and mufflers 22. The front and rear wheels 14, 16 rotate with respect to the frame 12 and support the frame 12 above the ground. The engine 20 is mounted to the frame 12 and drives the rear wheel 16. The illustrated engine 20 is an air-cooled four-stroke 45 degree V-twin engine. Some embodiments may include other types of engines, such as multi-cylinder engines of either the water-cooled or air-cooled variety. The motorcycle 10 includes mufflers 22 that direct exhaust gases and heat produced by the engine 20 and that reduce noise created during engine 20 operation. Headers 24 are coupled between the engine 20 and the mufflers 22 to route exhaust gases to the mufflers 22.

Figure 2:
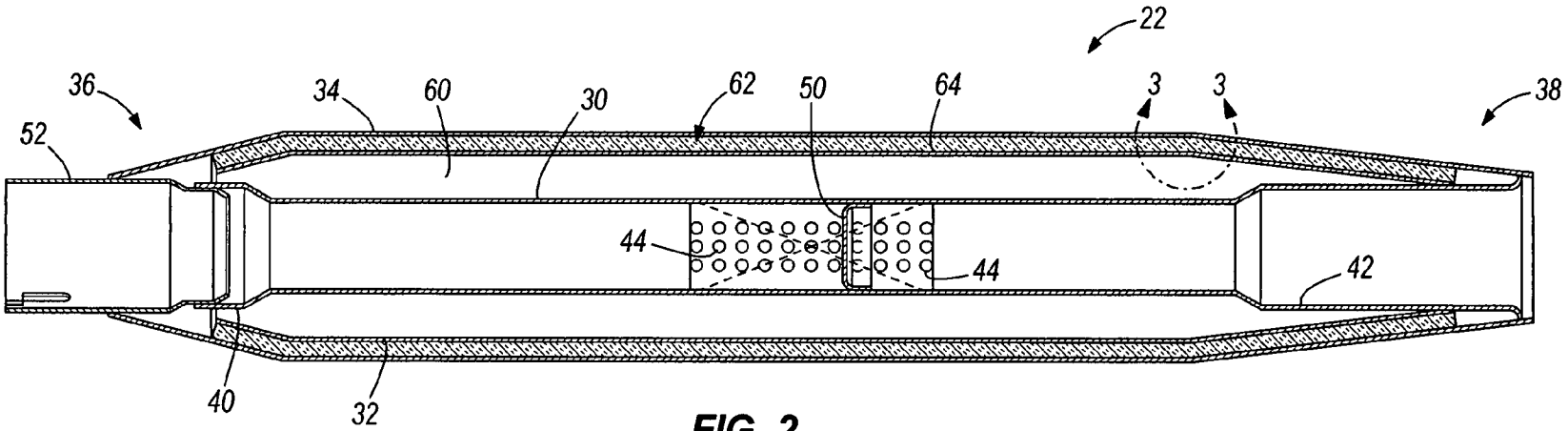
FIG. 2 is a section view of the muffler of FIG. 1.
Figure 3:
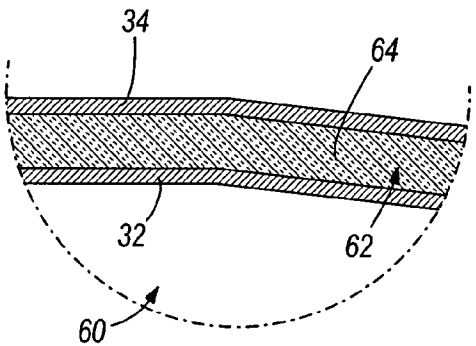
FIG. 3 is an enlarged section view of the muffler of FIG. 1.

Referring to FIGS. 2 and 3, the muffler 22 includes an inner tube 30, an intermediate tube 32, an outer tube 34 or shell, an inlet end 36, and an outlet end 38. The inner tube 30, intermediate tube 32, and outer tube 34 are substantially cylindrical thin-walled pipes of varying diameter. The inner tube 30 includes a first flared end 40 near the inlet end 36 of the muffler 22, and a second flared end 42 near the outlet end 38 of the muffler 22. In the illustrated embodiment, perforations or apertures 44 provide fluid communication between the interior and exterior of the inner tube 30. A baffle 50 is disposed within the inner tube 30 such that at least one aperture 44 exists between the baffle 50 and the inlet end 36, and at least one aperture 44 exists between the baffle 50 and the outlet end 38. The illustrated baffle 50 is a thin piece of metal having a diameter that substantially matches the inner diameter of the inner tube 30, allowing the baffle 50 to form a seal with the inner circumference of the inner tube 30 to inhibit the passage of the exhaust gases through the length of the inner tube 30. In some embodiments, as few as one aperture 44 may exist on either side of the baffle 50. The first flared end 40 of the inner tube 30 is adapted to receive an inlet flange 52. The inlet flange 52 couples the inlet end 36 of the muffler 22 to one of the headers 24 and defines a flow path for exhaust between the header 24 and the muffler 22.

The intermediate tube 32 at least partially surrounds the inner tube 30 and defines an intermediate chamber 60. In some embodiments, the intermediate tube 32 is constructed of a metal mesh such as the mesh available from Southwestern and identified as Wire Cloth—8 mesh (8×8), which is 0.028 inches thick and constructed of 304 Stainless Steel. Some embodiments may include an intermediate tube 32 with slots, holes, or any other form of aperture providing access from the chamber 60 to the exterior of the intermediate tube 32.

The outer tube 34 at least partially surrounds the intermediate tube 32 and the inner tube 30 and defines an outer chamber 62. In the illustrated embodiment, the outer tube 34 is constructed of metal, preferably with a polished or chrome finish on the exterior surface for an aesthetically pleasing appearance. In some embodiments, the outer tube 34 can be made from a plastic or composite material. The outer tube 34 is tapered at both the inlet end 36 and the outlet end 38 such that the ends of the outlet tube 34 form a seal with the inlet flange 52 at the inlet end 36 and with the inner tube 30 at the outlet end 38.

With continued reference to FIGS. 2 and 3, the muffler also includes insulation 64 or noise attenuating material substantially filling the chamber 62 between the intermediate tube 32 and the outer tube 34. In some embodiments, the insulation 64 is a single strand of fiberglass roving wrapped around the intermediate tube 32, such as Owens-Corning Advantex (RMU-162A), which has a density of approximately 100 kg/m$^3$, or DBW Powertex. When the insulation 64 is wrapped around the intermediate tube 32, a binder, or glue, is applied that helps secure the insulation 64 to the intermediate tube 32. After application of the binder, the intermediate tube 32 and insulation 64 are air-dried to stiffen the insulation 64. Additionally, the insulation 64 is applied evenly across the length of the intermediate tube 32 thereby maintaining the tapered ends of the combination to ease assembly of the muffler 22. The binder helps to retain the tapered ends of the first insulation 64 on the intermediate tube 32. In some embodiments, the binder may be tape, epoxy, or any other material suitable for securing the insulation 64 to the intermediate tube 32 while withstanding the heat generated by the exhaust gases. The insulation 64 substantially fills the chamber 62 between the intermediate tube 32 and the outer tube 34.

Figure 4:
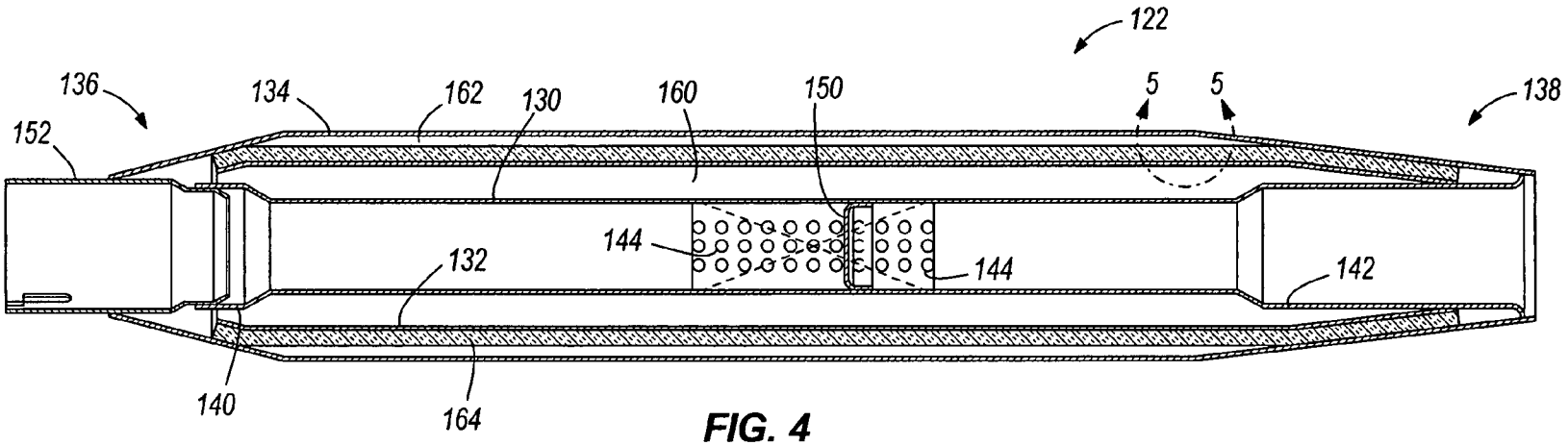
FIG. 4 is a section view of a second embodiment of the invention.
Figure 5:
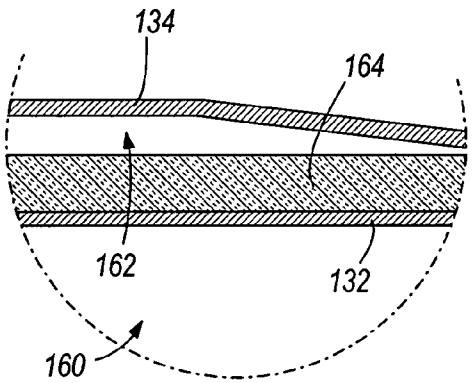
FIG. 5 is an enlarged section view of the muffler of FIG. 4.

In the embodiment illustrated in FIGS. 4 and 5, similar reference numbers in the 100 series are used to identify structure that is similar to the structure illustrated in the first embodiment shown in FIGS. 1-3. The muffler 122 includes an intermediate tube 132 of a smaller diameter than the intermediate tube 32 of FIGS. 2 and 3, and insulation 164 having substantially the same thickness as the insulation 64 included in the muffler 22 of FIGS. 2 and 3. Because the intermediate tube 132 is a smaller diameter than the intermediate tube 32, and because the outer tube 134 is the same diameter as the outer tube 34, the insulation 164 only fills a portion of the chamber 162 between the intermediate tube 132 and the outer tube 134.

Figure 6:
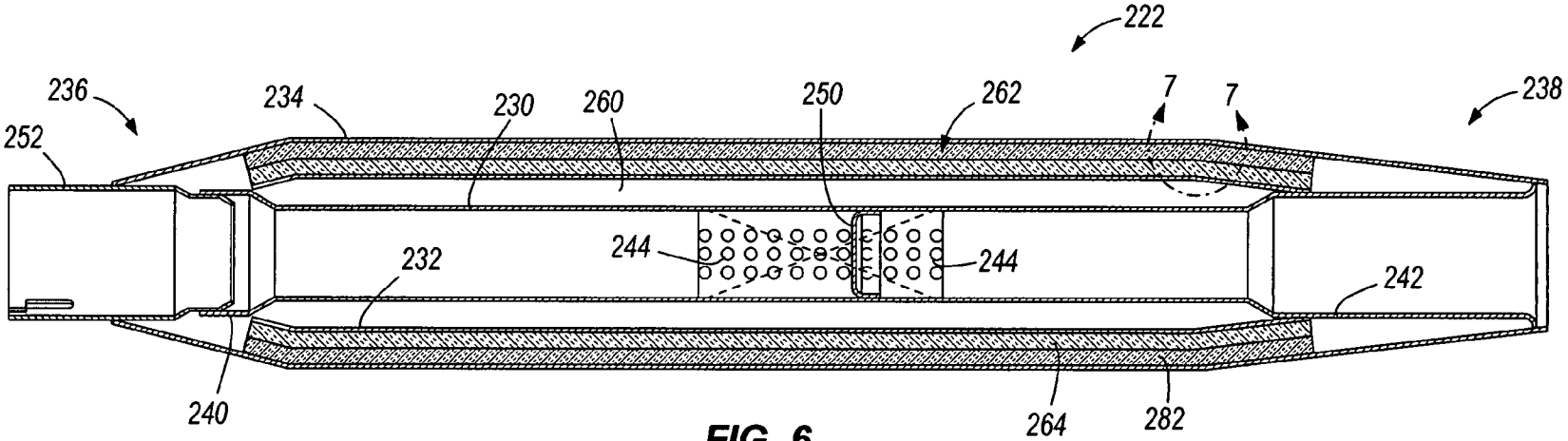
FIG. 6 is a section view of a third embodiment of the invention.
Figure 7:
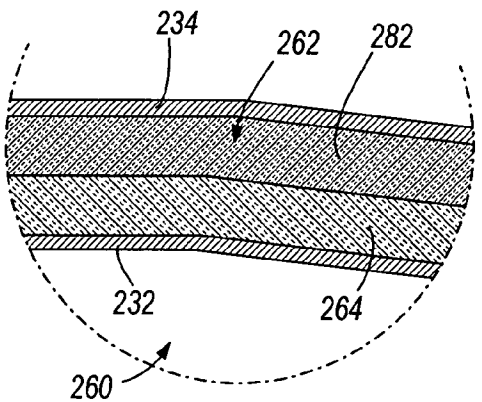
FIG. 7 is an enlarged section view of the muffler of FIG. 6.

In the embodiment illustrated in FIGS. 6 and 7, similar reference numbers in the 200 series are used to identify structure that is similar to the structure illustrated in the first embodiment shown in FIGS. 1-3. The muffler 222 includes an intermediate tube 232 of equal or smaller diameter than the intermediate tube 132 of FIGS. 4-5, and insulation 264 having substantially the same thickness as the insulation 164. As in the previous embodiments, the outer tube 234 defines a chamber 262 between the intermediate tube 232 and the outer tube 234. In addition to the insulation 264, the muffler 222 of FIGS. 6 and 7 includes another layer of insulation 282 or noise attenuating material disposed between the intermediate tube 232 and the outer tube 234. In the illustrated embodiment, the insulation 282 is fiberglass mat disposed between the insulation 264 and the outer tube 234. In some embodiments, the insulation 282 is BGF Techmat, with a density of approximately 96 kg/m$^3$, which is able to withstand the high temperatures associated with exhaust gas. Tape is used to secure the insulation 282 about the interior layer of insulation 264. The tape helps to stiffen the layer of 282, and is also applied tightly to slightly taper the ends to ease assembly of the muffler 222. In the illustrated embodiment, the insulations 264, 282 substantially fill the chamber 262 between the outer tube 234 and the intermediate tube 232. In some embodiments, the insulations 264, 282 may not fill the entire chamber 262, similar to the embodiment of FIGS. 4 and 5.

Figure 9:
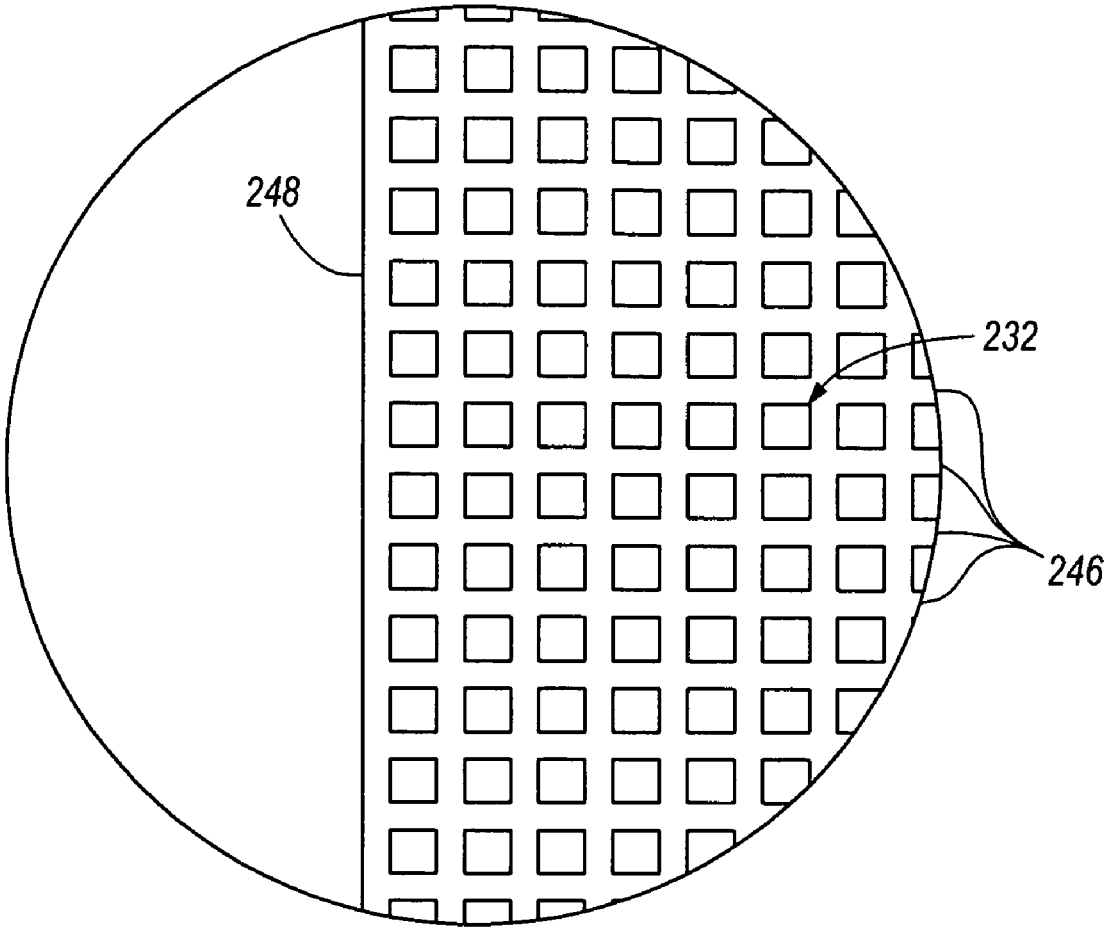
FIG. 9 is an enlarged view of an intermediate tube of the muffler of FIG. 6.

The intermediate tube 232 is constructed of a metal mesh as described above with respect to the first embodiment. As shown in FIG. 9, the mesh is trimmed such that none of the wires 246 extend perpendicularly beyond the edge 248 of the intermediate tube 32. This minimizes damage to the insulations 264, 282. If the insulations 264, 282 become pierced or torn, the inner tube 230 may rattle.

Each of the mufflers 22, 122, 222 of FIGS. 2-7 operates similarly, and therefore only the operation of the muffler 22 of the first embodiment is described below. While the motorcycle engine 20 is running, exhaust gas is forced from the engine 20, through the headers 24, and into the inlet end 36 and inner tube 30 of the mufflers 22. In each muffler 22, the exhaust gas is forced through the inner tube 30 until encountering the baffle 50, at which point the exhaust gas is forced through the apertures 44 into the chamber 60 between the inner tube 30 and the intermediate tube 32. Due to the pressure of exhaust gas entering the chamber 60 through the apertures 44 between the baffle 50 and the inlet end 36 of the muffler 22, the exhaust gas in the chamber 60 is forced to flow back into the inner tube 30 through the apertures 44 between the baffle 50 and the outlet end 38 of the muffler 22. Some of the exhaust gas entering the chamber 60 passes through the intermediate tube 32 and through the insulation 64 before being directed back into the inner tube 30. The insulation 64 disposed between the intermediate tube 32 and the outer tube 34 attenuate the noise created by the engine 20, and also reduce heat transfer from the exhaust gas to the outer tube 34. By varying the diameter of the intermediate tube 32, the quantity of insulation, and number of different insulations used, the distance between the inner tube 30 and the intermediate tube 32 can be varied, which can enhance or restrict the flow of exhaust gases. Varying this distance allows the muffler 22 to be tuned to maximize noise attenuation and engine performance.

The first step in assembling the muffler 22 is welding the inlet flange 52 onto the tapered end of the outer tube 34. At this stage, only one end of the outer tube 34 includes a taper. Next, a fiberglass tube assembly is inserted into the outer tube 34 until it reaches the tapered end of the outer tube 34. The fiberglass tube assembly comprises one of the intermediate tube 32 wrapped with the appropriate layers of insulation, depending on the application. After the fiberglass tube assembly is installed, the inner tube 30 is inserted into the outer tube 34, and the inlet flange 52 is received in the inlet side 36 of the inner tube 30. Next, the outlet end 38 of the outer tube 34 is domed or tapered, and the outlet end 38 of the inner tube 30 is welded to the outer tube 34. Finally, any brackets necessary to mount the muffler 22 to the motorcycle 10 are welded to the outer tube 34, and a chrome finish is applied to the exterior of the outer tube 34.

Figure 8:
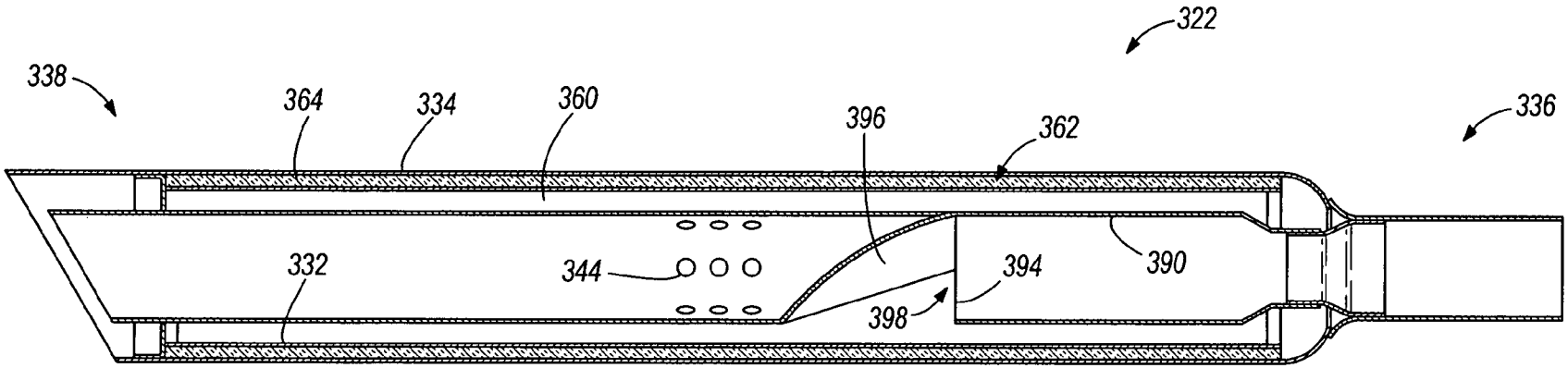
FIG. 8 is a section view of a fourth embodiment of the invention.

FIG. 8 illustrates yet another embodiment of the present invention. Similar reference numbers in the 300 series are used to identify structure that is similar to the structure illustrated in the first embodiment shown in FIGS. 1-3. The muffler 322 of this embodiment includes an intermediate tube 332 and an outer tube 334 similar to the embodiments of FIGS. 2-7, but the inner tube 332 of the embodiments of FIGS. 2-7 is replaced with a pierced tube 390. The pierced tube 390 defines a chamber 360 between the intermediate tube 332 and the pierced tube 390. To construct the pierced tube 390, a cut 94 is made in the tube 390 perpendicular to the axis defined by the tube 390 to approximately the center of the tube 390. A portion 396 of the tube between the cut 394 and the outlet end 338 of the muffler 322 is depressed until the portion 396 of the tube 390 being depressed contacts the inner half-circumference of the tube 390. The portion 396 is then joined to the inner surface of the tube 390 by welding, soldering, or any other suitable method of sealing pipe. Depressing a portion of the pipe in this fashion creates an exit region 398 in the tube 390 where the cut 394 was made. The exit region 398 is an aperture that is substantially the same diameter as the tube 390.

As exhaust gas is forced into the inlet end 336 of the muffler 322, it is forced through the exit region 398 into the chamber 360 between the pierced tube 390 and the intermediate tube 332. As with previous embodiments, continuous exhaust gas entering the chamber 360 forces the exhaust gas through perforations 344 into the pierced tube 390. Since the portion 396 of the tube 390 is sealed against the inner surface of the tube 390, the exhaust gas is forced through the outlet end 338 of the muffler 322.

The illustrated embodiment of FIG. 8 includes insulation 364 arranged within the chamber 362 similarly to the insulation 64 of FIG. 1. In some embodiments, the muffler 322 can include any of the insulation arrangements mentioned earlier with respect to the embodiments of FIGS. 2-7.

Thus, the invention provides, among other things, a motorcycle muffler including an inner tube, an intermediate tube, an outer tube, and insulation disposed between the intermediate tube and the outer tube. Various features and advantages of the invention are set forth in the following claims.

What is claimed is:

1. A muffler for a motorcycle having an engine producing exhaust gases, the muffler comprising:

an outer tube;

an inner tube disposed substantially within the outer tube, the inner tube including a first end adapted to receive the exhaust gases from the engine and a second end opposite the first end adapted to release the exhaust gases to the environment, the inner tube including first and second apertures positioned between the ends;

an intermediate tube disposed between the outer tube and the inner tube and defining a chamber between the intermediate tube and the inner tube such that the exhaust gases exit the inner tube through the first aperture into the chamber, and exit the chamber into the inner tube through the second aperture;

a first layer of a noise attenuating material disposed between the intermediate tube and the outer tube; and a second layer of a noise attenuating material disposed between the intermediate tube and the outer tube.

2. The muffler of claim 1, wherein the first layer of noise attenuating material is single-strand fiberglass roving.

3. The muffler of claim 1, wherein the inner tube is pierced, crimped, and sealed to define the first aperture.

4. The muffler of claim 2, wherein the second layer of noise attenuating material is fiberglass mat and is disposed radially outward of the first layer of noise attenuating material.

5. The muffler of any one of claim 1, claim 2, and claim 4, wherein the first and second layers of noise attenuating material substantially fill the volume between the intermediate tube and the outer tube.

6. The muffler of any one of claim 1, claim 2, and claim 4, wherein the first layer of noise attenuating material substantially fills a portion of the volume between the intermediate tube and the outer tube, and the second layer of noise attenuating material fills only a portion of the remaining volume between the first layer of noise attenuating material and the outer tube.

7. A muffler for a motorcycle having an engine producing exhaust gases, the muffler comprising:

an outer tube;

an inner tube disposed substantially within the outer tube, the inner tube including a first end adapted to receive the exhaust gases from the engine and a second end opposite the first end adapted to release the exhaust gases to the environment, the inner tube including first and second apertures positioned between the ends;

an intermediate tube disposed between the outer tube and the inner tube and defining a chamber between the intermediate tube and the inner tube such that the exhaust gases exit the inner tube through the first aperture into the chamber, and exit the chamber into the inner tube through the second aperture; and single-strand fiberglass roving disposed between the intermediate tube and the outer tube.

8. The muffler of claim 7, wherein the intermediate tube is mesh.

9. The muffler of claim 7, wherein the single-strand fiberglass roving substantially fills the volume between the intermediate tube and the outer tube.

10. The muffler of claim 7, wherein the single-strand fiberglass roving substantially fills a portion of the volume between the intermediate tube and the outer tube.

11. The muffler of claim 10, wherein fiberglass mat substantially fills the remaining volume between the intermediate tube and the outer tube.

12. The muffler of claim 7, wherein the inner tube is pierced, crimped, and sealed to define the first aperture.

13. A muffler for a motorcycle having an engine producing exhaust gases, the muffler comprising:

an outer tube;

an inner tube disposed substantially within the outer tube, the inner tube including a first end adapted to receive the exhaust gases from the engine and a second end opposite the first end adapted to release the exhaust gases to the environment, the inner tube including first and second apertures positioned between the ends;

an intermediate tube disposed between the outer tube and the inner tube and defining a chamber between the intermediate tube and the inner tube such that the exhaust gases exit the inner tube through the first aperture into the chamber, and exit the chamber into the inner tube through the second aperture;

single-strand fiberglass roving disposed between the intermediate tube and the outer tube; and fiberglass mat disposed between the intermediate tube and the outer tube.

14. The muffler of claim 13, wherein the intermediate tube is mesh.

15. The muffler of claim 13, wherein the single-strand fiberglass roving substantially fills a portion of the volume between the intermediate tube and the outer tube, and wherein the fiberglass mat substantially fills the remaining volume between the intermediate tube and the outer tube.

16. The muffler of claim 13, wherein the inner tube is pierced, crimped, and sealed to define the first aperture.

* * * * *